US008006673B2

(12) United States Patent
Suzuki et al.

(10) Patent No.: US 8,006,673 B2
(45) Date of Patent: Aug. 30, 2011

(54) FUEL INJECTION PUMP

(75) Inventors: Masashi Suzuki, Obu (JP); Hiroyuki Shimai, Kariya (JP)

(73) Assignee: Denso Corporation, Kariya (JP)

( * ) Notice: Subject to any disclaimer, the term of this patent is extended or adjusted under 35 U.S.C. 154(b) by 402 days.

(21) Appl. No.: 12/333,622

(22) Filed: Dec. 12, 2008

(65) Prior Publication Data

US 2009/0159054 A1 Jun. 25, 2009

(30) Foreign Application Priority Data

Dec. 21, 2007 (JP) ..... 2007-330123

(51) Int. Cl.
*F02M 37/06* (2006.01)
*F02M 37/04* (2006.01)

(52) U.S. Cl. ..... 123/506; 123/450

(58) Field of Classification Search ..... 123/450, 123/506, 495, 500, 504, 446; 417/273, 462
See application file for complete search history.

(56) References Cited

U.S. PATENT DOCUMENTS

| | | | | |
|---|---|---|---|---|
| 4,453,522 | A | 6/1984 | Salzgeber | |
| 6,289,875 | B1 | 9/2001 | Shinohara et al. | |
| 6,722,864 | B2 * | 4/2004 | Suzuki et al. | 417/470 |
| 7,080,631 | B2 * | 7/2006 | Hanyu | 123/495 |
| 2003/0221552 | A1 | 12/2003 | Onishi et al. | |
| 2005/0100448 | A1 | 5/2005 | Graf et al. | |
| 2006/0169251 | A1 | 8/2006 | Mori et al. | |
| 2008/0178845 | A1 | 7/2008 | Shimai | |

FOREIGN PATENT DOCUMENTS

| | | |
|---|---|---|
| JP | 02-146254 | 6/1990 |
| JP | 2-191863 | 7/1990 |
| JP | 2003-172230 | 6/2003 |
| JP | 2003-269342 | 9/2003 |
| JP | 2004-332645 | 11/2004 |
| JP | 2007-146862 | 6/2007 |

OTHER PUBLICATIONS

Extended European Search Report dated Apr. 14, 2009, issued in corresponding European Application No. 08170507.1-2311.
Chinese Office Action dated Jun. 10, 2010, issued in corresponding Chinese Application No. 200810176271.7, with English translation.
Japanese Office Action dated Oct. 20, 2009, issued in corresponding Japanese Application No. 2007-330123, with English translation.

* cited by examiner

*Primary Examiner* — Mahmoud Gimie
(74) *Attorney, Agent, or Firm* — Nixon & Vanderhye PC

(57) ABSTRACT

A low-pressure pump portion pumps fuel from a fuel tank. A pressure regulating valve controls pressure of fuel discharged from the low-pressure pump portion. A high-pressure pump portion pressurizes the discharged fuel. A valve cover has a mounting portion mounted with the pressure regulating valve. A camshaft moves a movable member to pressurize fuel in a high-pressure pump chamber of a cylinder so as to press-feed the fuel from the high-pressure pump portion. The low-pressure pump portion includes a rotatable member, which is rotatable integrally with the camshaft, and a pump cover, which accommodates the rotatable member. The pump cover is fixed to the pump housing. The valve cover is a separate component from the pump housing and the pump cover.

8 Claims, 8 Drawing Sheets

FUEL INJECTION PUMP

CROSS REFERENCE TO RELATED APPLICATIONS

This application is based on and incorporates herein by reference Japanese Patent Application No. 2007-330123 filed on Dec. 21, 2007.

FIELD OF THE INVENTION

The present invention relates to a fuel injection pump including a low-pressure pump portion for pumping fuel from a fuel tank and a fuel pressure regulating valve for regulating pressure of fuel discharged from the low-pressure pump portion.

BACKGROUND OF THE INVENTION

A conventional fuel injection pump applied to an accumulator fuel injection system for a diesel engine is disclosed in JP-A-2000-240531.

The fuel injection pump disclosed in JP-A-2000-240531 includes a low-pressure pump portion, a fuel pressure regulating valve (return valve), and a high-pressure pump portion. The low-pressure pump portion (feed pump portion) pumps fuel from a fuel tank. The fuel pressure regulating valve (return valve) regulates pressure of fuel discharged from the feed pump portion. The high-pressure pump portion further pressurizes fuel, which is discharged from the feed pump portion, and press-feeds the fuel to a common rail, which stores the fuel at high-pressure.

The return valve opens and returns fuel from the downstream of the feed pump portion to the upstream of the feed pump portion when pressure of fuel discharged from the feed pump portion becomes greater than predetermined pressure. The return valve is inserted to a mounting hole (mounting portion) provided in a pump housing as an outer shell of the fuel injection pump, thereby the return valve is mounted to the fuel injection pump.

However, the pump housing of the fuel injection pump disclosed in JP-A-2000-240531 includes the high-pressure pump portion and the feed pump portion. The pump housing is formed with multiple fuel passages and a mounting portion to which a component such as the feed pump portion is mounted. Therefore, interference between fuel passages and the mounting hole, in which the return valve in pump housing is inserted, needs to be avoided when the mounting hole is formed. Accordingly, manufacturing of the mounting hole is complicated.

In view of the present problem, the present inventor filed the Japanese patent application No. 2007-21378 to propose a structure in which the mounting hole, to which the return valve is inserted, is formed in the feed pump cover (low-pressure pump cover), which is a separate component from the pump housing. In the present structure of the fuel injection pump, workability of the mounting hole is enhanced compared with JP-A-2000-240531 in which the mounting hole is formed in the pump housing.

The low-pressure pump cover functions as an outer shell of the feed pump portion. The low-pressure pump cover is fixed to the pump housing by using a bolt or the like while accommodating a rotatable member of the feed pump portion. Specifically, a trochoid rotor of a trochoid pump as the feed pump portion is accommodated in the low-pressure pump cover.

In short, the low-pressure pump cover functions as a part of the feed pump portion. In addition, the low-pressure pump cover also functions as a mounting member used for mounting the feed pump portion to the pump housing. The low-pressure pump cover accommodates the rotatable member of the feed pump. Therefore, high dimensional accuracy of, for example, tens of microns is required to the low-pressure pump cover when the inside of the low-pressure pump cover is manufactured.

Therefore, the outline of the low-pressure pump cover may be complicated for being chucked when the inside of the low-pressure pump is manufactured. Moreover, when the mounting hole, to which the return valve is inserted, is formed after manufacturing the inside of the low-pressure pump cover with high accuracy, the inside of the low-pressure pump cover may be deformed. Accordingly, in the fuel injection pump according to the Japanese patent application No. 2007-21378, workability of the mounting hole may not be sufficiently enhanced.

SUMMARY OF THE INVENTION

In view of the foregoing and other problems, it is an object of the present invention to produce a fuel injection pump in which workability of a mounting portion of a fuel pressure regulating valve is enhanced.

According to one aspect of the present invention, a fuel injection pump comprises a low-pressure pump portion configured to pump fuel from a fuel tank. The fuel injection pump further comprises a pressure regulating valve configured to control pressure of fuel discharged from the low-pressure pump portion. The fuel injection pump further comprises a high-pressure pump portion configured to pressurize fuel discharged from the low-pressure pump portion to press-feed the fuel. The fuel injection pump further comprises a valve cover having a mounting portion, which is configured to be mounted with the pressure regulating valve. The high-pressure pump portion includes a cylinder, a movable member, and a camshaft. The cylinder defines a high-pressure pump chamber for compressing fuel. The movable member is configured to move to pressurize fuel in the high-pressure pump chamber to press-feed the fuel. The camshaft is configured to move the movable member. The low-pressure pump portion includes a rotatable member and a pump cover. The rotatable member is rotatable integrally with the camshaft. The pump cover accommodates the rotatable member. The pump cover is fixed to the pump housing. The valve cover is a separate component from the pump housing and the pump cover.

In the present structure, interference between the mounting portion, the multiple fuel passages provided in pump housing and the like need not be considered when the mounting portion is manufactured. In addition, deformation caused in the inside of the low-pressure pump cover need not be considered when the mounting portion is manufactured. Consequently, manufacturing of the mounting portion of the return valve can be sufficiently facilitated, compared with the fuel injection pump disclosed in JP-A-2000-240531.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
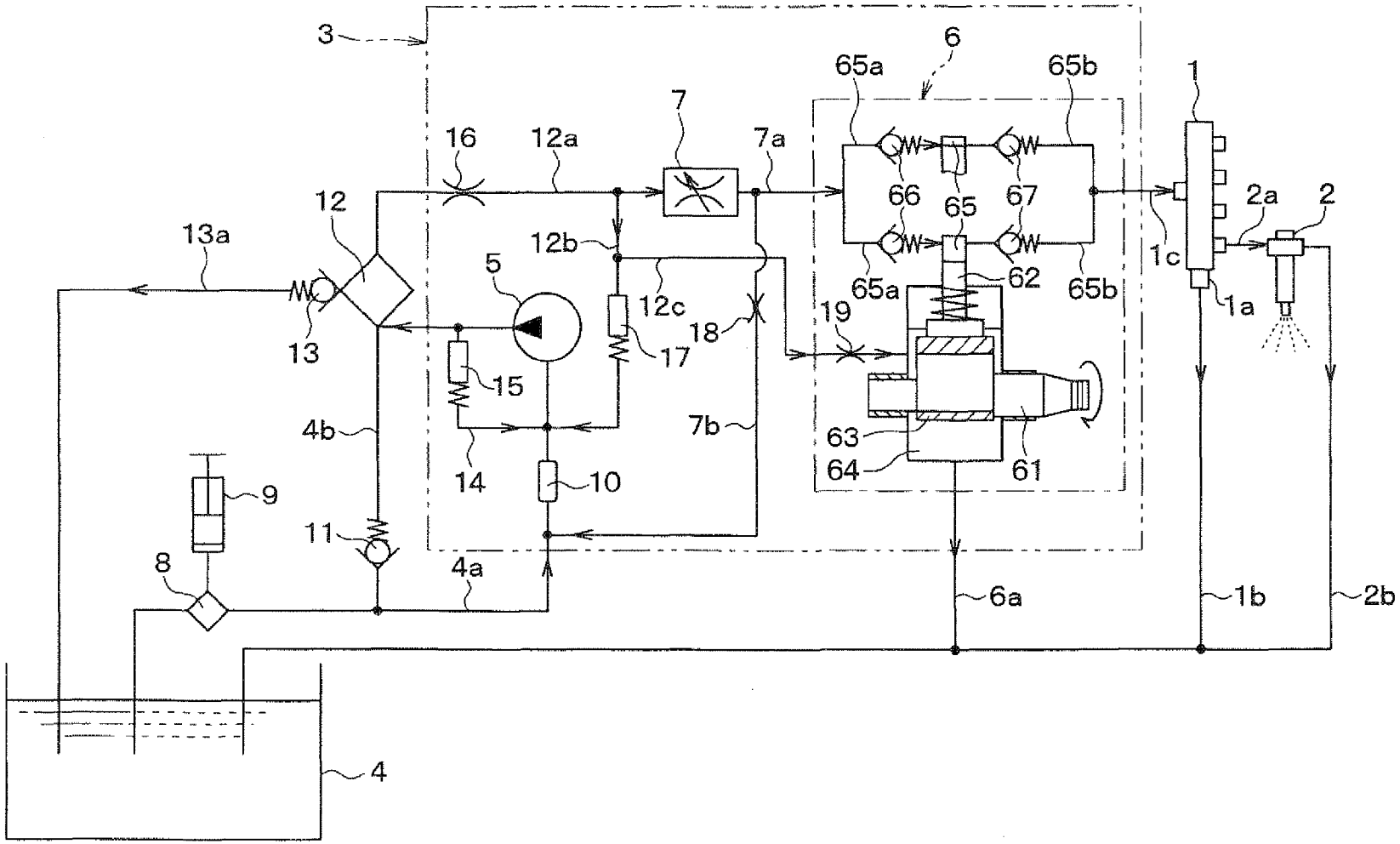
FIG. 1 is a schematic diagram showing an accumulator fuel injection system according to a first embodiment.

The present first embodiment will be described with reference to FIGS. 1 to 6. FIG. 1 is an overview diagram showing an accumulator fuel injection system having a fuel injection pump 3 for a diesel engine for a vehicle. The present accumulator fuel injection system is applied to, for example, a four-cylinder diesel engine. The accumulator fuel injection system includes a common rail 1 for accumulating high-pressure fuel, injectors 2 for injecting the high-pressure fuel supplied from the common rail 1 respectively into combustion chambers of the diesel engine, the fuel injection pump 3 for feeding high-pressure fuel into the common rail 1, and a fuel tank 4 for receiving fuel.

The common rail 1 serves as an accumulating unit for accumulating high-pressure fuel supplied from the fuel injection pump 3 and holding the high-pressure fuel at target rail pressure. An unillustrated control unit (ECU) determines the target rail pressure in accordance with an operating condition such as a throttle position of an accelerator and rotation speed of the diesel engine. The common rail 1 is further provided with a pressure limiter 1*a*, which is configured to open so as to release fuel pressure in the common rail 1 when fuel pressure in the common rail 1 exceeds predetermined upper limit. The fuel flowing from the pressure limiter 1*a* returns into the fuel tank 4 through a fuel pipe 1*b*.

Each injector 2 serves as a fuel injection unit for injecting high-pressure fuel into the combustion chamber of the diesel engine. Each injector 2 is supplied with high-pressure fuel from the common rail 1 through a high-pressure pipe 2*a*. Fuel supplied from the common rail 1 is not partially injected, and the part of supplied fuel is returned as surplus fuel to the fuel tank through a fuel pipe 2*b*. The injector 2 is connected with an ECU, and thereby an injection timing and an injection amount are controlled according to a control signal transmitted from the ECU.

Figure 2:
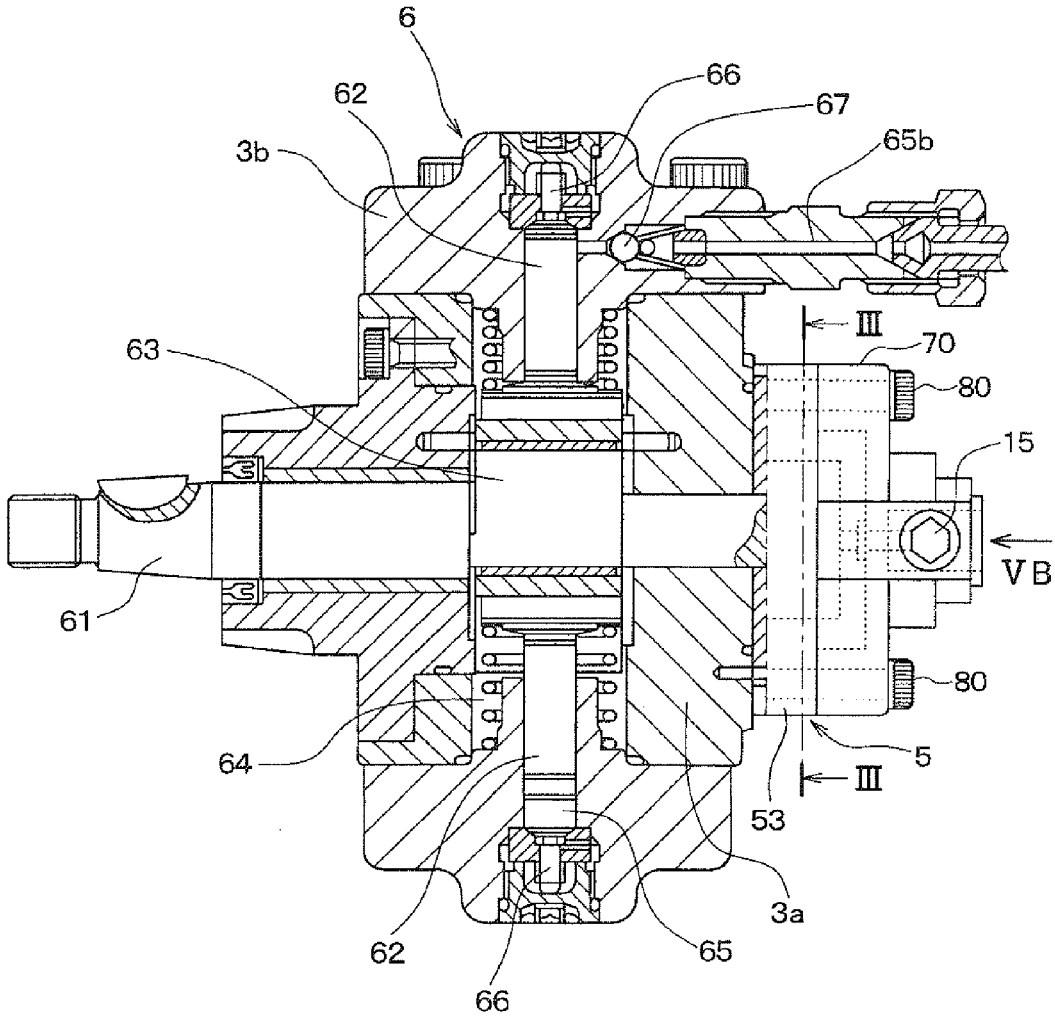
FIG. 2 is a sectional view showing a fuel injection pump according to the first embodiment.
Figure 3:
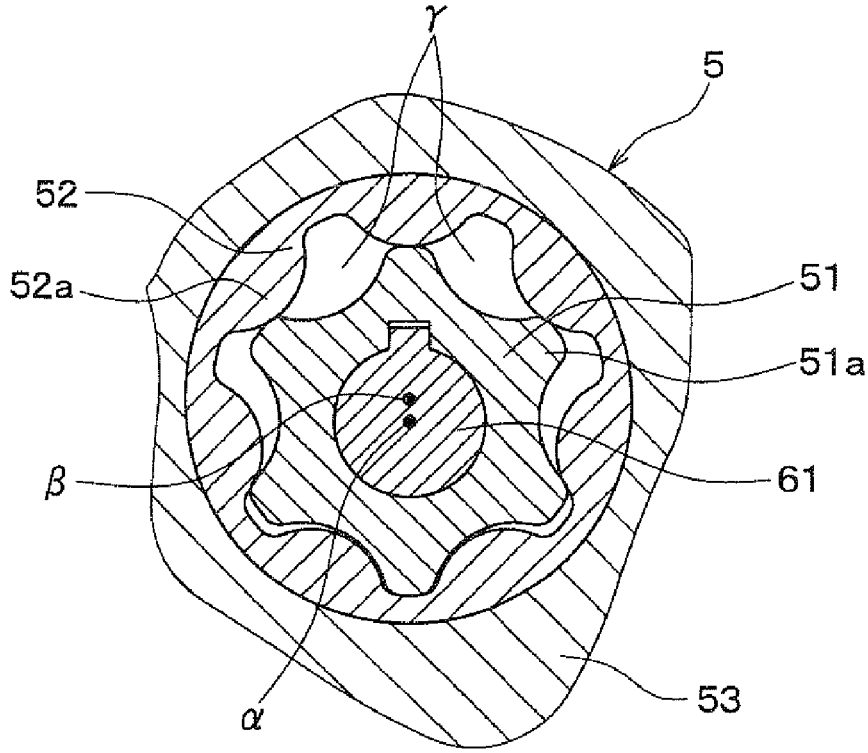
FIG. 3 is a sectional view taken along a line III-III in FIG. 2.

The fuel injection pump 3 will be described with reference to FIGS. 1 to 5. FIG. 2 is a sectional view showing the fuel injection pump 3 according to the present embodiment, and FIG. 3 is a sectional view taken along the line X-X in FIG. 2. The fuel injection pump 3 according to the present embodiment has components boxed with the two-dot chain line in FIG. 1. The present components of the fuel injection pump 3 are directly formed with a pump housing 3*a*, which defines an outer shell of the fuel injection pump 3. Alternatively, the present components of the fuel injection pump 3 may be separately prepared and attached to the outer shell of the fuel injection pump 3. More specifically, the fuel injection pump 3 includes a feed pump portion 5, a high-pressure pump portion 6, an inlet control valve 7, and a return valve 15. The feed pump portion 5 serves as a low-pressure pump portion and pumps fuel from the fuel tank 4. The high-pressure pump portion 6 further pressurizes the fuel discharged from the feed pump portion 5 and feeds the pressurized to the common rail 1. The inlet control valve 7 controls flow of fuel supplied from the feed pump portion 5 to the high-pressure pump portion 6. The return valve 15 regulates pressure of fuel discharged from the feed pump portion 5.

As show in FIG. 1, the feed pump portion 5 pumps fuel from the fuel tank 4 to the high pressure pump portion 6 through an inlet pipe 4*a*. The inlet pipe 4*a* is connected with an inlet of the feed pump portion 5. In present embodiment, a trochoid pump, which is an internal gear pump, is employed as the feed pump portion 5.

As shown in FIG. 31 the trochoid pump includes an inner rotor 51, an outer rotor 52, and a feed pump cover 53. The inner rotor 51 is formed with outer teeth 51*a*, which project radially outward. The outer rotor 52 is located outside of the inner rotor 51 and formed with inner teeth 52*a*, which project radially inward. The feed pump cover 53 accommodates the inner rotor 51 and the outer rotor 52. The inner rotor 51 is connected with one-end side of a camshaft 61 of the high-pressure pump portion 6. The inner rotor 51 is rotatable integrally with the camshaft 61. The inner rotor 51 and the outer rotor 52 are accommodated in the feed pump cover 53 in a state where the outer teeth 51*a* are meshed with the inner teeth 52*a*. In the present structure, the outer rotor 52 is rotatable in response to rotation of the inner rotor 51. The number of the outer teeth 51*a* of the inner rotor 51 is less than the number of the inner teeth 52*a* of the outer rotor 52 by one. For example, in the present embodiment, the numbers of the outer teeth 51*a* and the inner teeth 52*a* are respectively six and seven. Further, a rotation center a of the inner rotor 51 is eccentric with respect to a rotation center β of the outer rotor 52. In the present structure, multiple cavity portions γ defined between the outer teeth 51*a* and the inner teeth 52*a* are changed in volume in response to rotation of the inner rotor 51 and the outer rotor 52, thereby bringing pumping action. Therefore, in the present embodiment, the inner rotor 51 and the outer rotor 52 construct a rotatable member. The feed pump cover 53 defines an accommodation space, in which the inner rotor 51 and the outer rotor 52 are accommodated. Furthermore, as shown in FIG. 2, the feed pump cover 53 defines an outer shell of the feed pump portion 5. In addition, the feed pump cover 53 functions as a mounting member when the feed pump portion 5 is attached to the pump housing 3*a*.

Referring to FIG. 1, the inlet pipe 4*a* is connected with the inlet of the feed pump portion 5. The inlet pipe 4*a* is provided with a pre-filter 8 for removing foreign matters from fuel drawn from the fuel tank 4, and a priming pump 9 for venting gas from the inlet pipe 4*a* in, for example, an assembly work of the vehicle. Furthermore, a bypass passage 4*b* is connected to a passage between the pre-filter 8 and the fuel injection pump 3 in the inlet pipe 4*a*. The priming pump 9 is capable of pumping fuel to the downstream of the feed pump portion 5 through the bypass passage 4*b*. The bypass passage 4*b* is provided with a check valve 11 for restricting fuel from flowing backward. Furthermore, a gauze filter 10 is provided to the feed pump portion 5 in the fuel injection pump 3 for removing foreign matters contained in fuel flowing through the inlet pipe 4*a* downstream of the pre-filter 8. The gauze filter 10 and/or the pre-filter 8 may be a metallic filter such as a metallic mesh.

A fuel filter 12 is provided to the downstream of the feed pump portion 5 for filtering fuel discharged from the feed pump portion 5. A relief valve 13 is further provided to the downstream of the feed pump portion 5. The relief valve 13 is configured to open, i.e., communicate therethrough when pressure of the fuel applied to the fuel filter 12 becomes equal to or greater than predetermined pressure. Fuel, which is fed from the feed pump portion 5, is partially returned to the fuel tank 4 through a fuel pipe 13*a* in response to opening of the relief valve 13. The fuel filter 12 is provided outside the fuel injection pump 3 and connected with the fuel injection pump 3 via a fuel pipe. In the present structure, fuel is discharged from the feed pump portion 5, and the fuel once flows outside the fuel injection pump 3. Subsequently, the fuel again flows into the fuel injection pump 3 after being filtered through the fuel filter 12. The fuel filter can be applied with pressure of fuel discharged from the feed pump portion 5. Therefore, the fuel filter 12 may have a filtering mesh less than that of each of the pre-filter 8 and the gauze filter 10, so that the fuel filter 12 may have a filtering performance higher than that of each of the pre-filter 8 and the gauze filter 10. Thus, the fuel filter 12 is capable of removing particulate foreign matters, moisture, and the like, which cannot be removed using the pre-filter 8 and the gauze filter 10.

Furthermore, a return passage 14 is connected to a passage between the feed pump portion 5 and the fuel filter 12 inside the fuel injection pump 3 so as to return fuel to the upstream of the feed pump portion 5. The return passage 14 is provided with the return valve 15 (FIG. 4) for controlling flow of fuel returning to the upstream of the feed pump portion 5 through the return passage 14.

Figure 4:
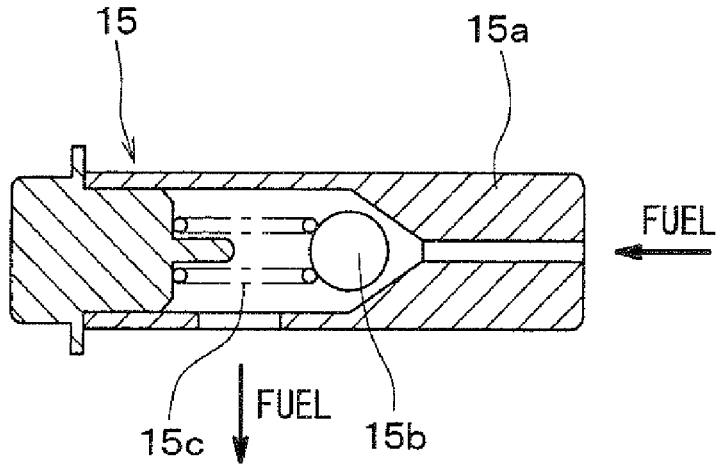
FIG. 4 is a schematic sectional view showing a return valve according to the first embodiment.

As shown in FIG. 4, the return valve 15 includes a housing 15*a*, a valve element portion 15*b*, and a spring 15*c*. The housing 15*a* therein has a fuel inlet port and a fuel outlet port. The valve element portion 11*b* is substantially in a ball shape and provided in the housing 15*a* so as to control throttle of a fuel passage inside the housing 15*a*. The spring 15*c* as a biasing member biases the valve element portion 15*b* in a closing direction. The return valve 15 is a fuel pressure regulating valve having the present mechanical structure and configured to control fuel pressure downstream of the feed pump portion 5 at predetermined pressure. Therefore, the return valve 15 has a function to release fuel pressure exerted onto the fuel filter 12.

Further, as shown in FIG. 2, the return valve 15 is mounted to the fuel injection pump 3 by fixing a rear cover 70 to the pump housing 3*a* in a state where the return valve 15 is inserted and fixed to a mounting hole 70*a* (mounting portion) of the rear cover 70. In the present embodiment, the rear cover 70 functions as a valve cover. The rear cover 70 and the feed pump cover 53 are fixed to the pump housing 3*a* by using bolts 80 as common stationary members. The return valve 15 is inserted and fixed to the rear cover 70, and therefore the rear cover 70 therein defines the return passage 14. The structure of the rear cover 70 will be described later in detail.

As show in FIG. 1, a fuel passage 12*a* is defined in the pump housing 3*a*. The inlet control valve 7 is connected downstream of the fuel filter 12 through the fuel passage 12*a*. Furthermore, the fuel passage 12*a* is provided with an orifice 16. The inlet control valve 7 is an electromagnetic valve having a linear solenoid, which is capable of manipulating throttle therein based on a control signal transmitted from the ECU. The ECU transmits the control signal in accordance with an operating condition of the diesel engine.

The orifice 16 serves as a throttle unit configured to throttle the fuel passage 12*a*, which extends from the fuel filter 12 to the inlet control valve 7, thereby restricting flow of fuel through the fuel filter 12. A passage between the orifice 16 and the inlet control valve 7 in the fuel passage 12*a* is connected with a passage between the gauze filter 10 and the feed pump portion 5 through a fuel passage 12*b*. The fuel passage 12*b* is provided with a regulator valve 17. The regulator valve 17 includes a mechanical structure similar to that of the return valve 15, and is capable of controlling pressure of fuel downstream of the orifice 16 at pressure equal to or less than predetermined pressure. The fuel passage 12*b* is connected with a fuel passage 12*c* through which fuel flows from the upstream of the inlet control valve 7 to a cam chamber 64 of the high-pressure pump portion 6. The high-pressure pump portion 6 is connected with the downstream of the inlet control valve 7 through a fuel passage 7*a*. The fuel passage 7*a* is further connected with a fuel passage 7*b* through which fuel returns to the upstream of the gauze filter 10 through an orifice 18. In the present structure, when, for example, the inlet control valve 7 closes, surplus fuel is capable of returning from the downstream of the inlet control valve 7 to the upstream of the feed pump portion 5.

As shown by the portion boxed with the two-dot chain line in FIG. 1 and FIG. 2, the high-pressure pump portion 6 includes the camshaft 61 being rotatable as driven by the diesel engine, a plunger 62 as a movable member being axially movable inside a cylinder 3*b* by being transmitted with driving force from the camshaft 61, and the like. The high-pressure pump portion 6 includes two plungers 62 being opposed to each other with respect to the radial direction of the camshaft 61. The plungers 62 alternately move to draw and press-feed fuel. The camshaft 61 is connected with a cam 63 capable of converting a rotative movement of the camshaft 61 to an axial movement and transmitting the axial movement to the plungers 62. The cam 63 is accommodated in the cam chamber 64 of the pump housing 3*a*. In the present structure, fuel flows into the cam chamber 64 through the fuel passage 12*c*, and the fuel serves as lubricating oil in transmission of driving force from the cam 63 to the plunger 62.

Referring to FIG. 1, the fuel passage 12*c* is provided with an orifice 19. The orifice 19 regulates fuel as lubricating oil flowing into the cam chamber 64. Surplus fuel overflowing from the cam chamber 64 returns to the fuel tank 4 through a fuel passage 6*a*. The cylinder 3*b* therein defines a high-pressure pump chamber 65, which variably changes in volume correspondingly to the axial movement of the plunger 62. The high-pressure pump chamber 65 is connected with an inlet passage 65*a*, through which fuel passes from the fuel passage 7*a* to the high-pressure pump chamber 65, and an outlet passage 65*b*, through which fuel passes from the high-pressure pump chamber 65 to the common rail 1. The inlet passage 65*a* is provided with an inlet valve 66, which opens when fuel flows into the high-pressure pump chamber 65. The outlet passage 65*b* is provided with an outlet valve 67, which opens when fuel flows out of the high-pressure pump chamber 65. The outlet passage 65*b* is connected with the common rail 1 through a fuel passage 1*c*. As shown in FIG. 2, the pump housing 3*a* according to the present embodiment mainly defines the outer shell of the high-pressure pump portion 6.

Figure 5A:
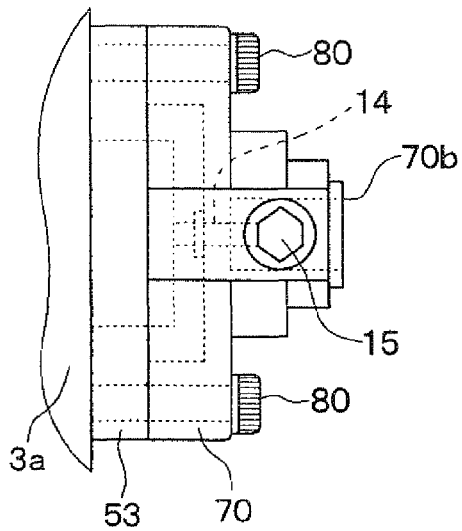
FIG. 5A is an enlarged view showing a feed pump according to the first embodiment.
Figure 5B:
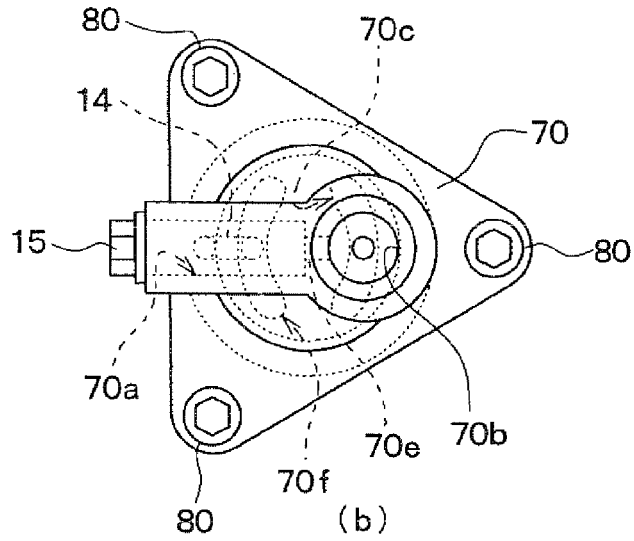
FIG. 5B is a top view when being viewed from an axial direction along the arrow VB in FIG. 2.

Next, the structure of the rear cover 70 according to the present embodiment is described with reference to FIG. 5. FIG. 5A is an enlarged view showing the feed pump portion 5 in FIG. 1. FIG. 5B is a top view when being viewed from the direction of the camshaft 61 along the arrow VB in FIG. 2.

Figure 5C:
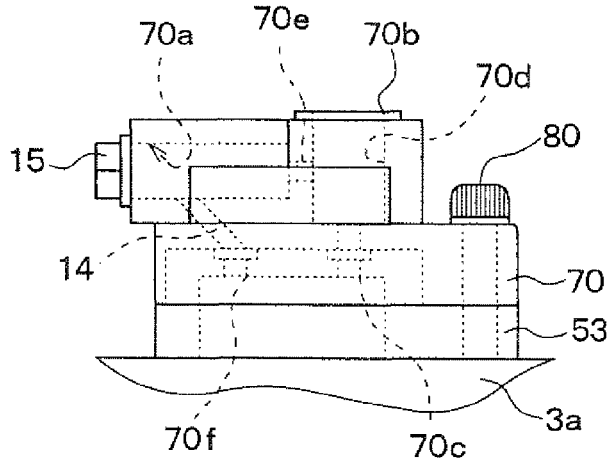
FIG. 5C is a lateral view showing the feed pump.
Figure 6A:
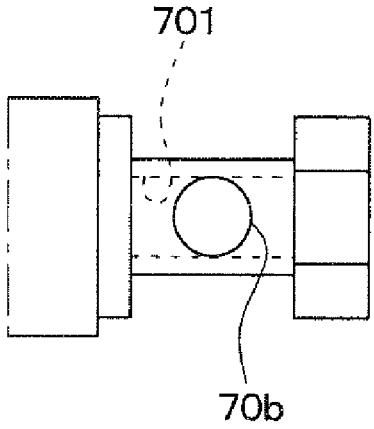
FIG. 6A is a side view showing a hollow screw having a fuel outlet hole of the fuel injection pump.
Figure 6B:
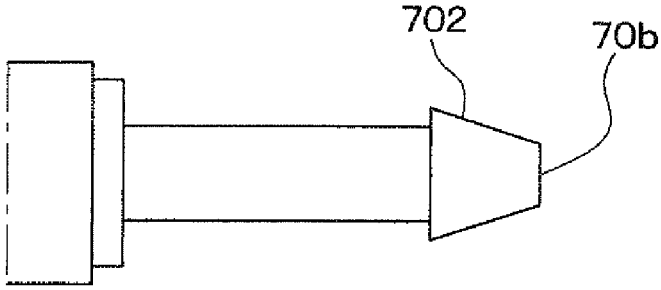
FIG. 6B is a side view showing a pipe member having a fuel outlet hole.

FIG. 5C is a lateral view showing the feed pump portion 5. As shown in FIGS. 5A to 5C, the pump housing 3*a*, the feed pump cover 53, and the rear cover 70 are separate components. Each of the feed pump cover 53 and the rear cover 70 has through holes. The feed pump cover 53 and the rear cover 70 are screwed and fixed to the pump housing 3*a* with the bolts 80, which pass through the through holes. The mounting hole 70*a* is formed in the rear cover 70, and the return valve 15 is inserted and fixed to the mounting hole 70*a*. The inner periphery of the mounting hole 70*a* defines a female screw portion (not shown), and the outer circumferential periphery of the return valve 15 defines a male screw portion (not shown). The male screw portion is screwed to the female screw portion, so that the return valve 15 is attached to the rear cover 70.

Further, as shown in FIGS. 5A to 5C, the axial direction (longitudinal direction) of the mounting hole 70*a* is inclined, i.e., at an angle with respect to the axial direction of the camshaft 61. For example, in the present embodiment, the axial direction of the mounting hole 70*a* is substantially at a 90 degree angle with respect to the axial direction of the camshaft 61. Therefore, the longitudinal direction of the return valve 15 is also substantially at a 90 degree angle with respect to the axial direction of the camshaft 61. That is, the longitudinal direction of the return valve 15 is substantially in parallel with the wall surface of the pump housing 3*a* to which the feed pump portion 5 is fixed. The rear cover 70 has a fuel outlet port 70*b* through which fuel is press-fed to the fuel filter 12, which is located outside the fuel injection pump 3. The fuel outlet port 70*b* may be constructed of a hollow screw shown in FIG. 6A or a pipe member shown in FIG. 6B. When the fuel outlet port 70*b* is constructed of a hollow screw, a screw portion therein defines a fuel passage 701. Further, the wall surface of the screw portion defining the fuel passage 701 is provided with the fuel outlet port 70*b*, which communicates the inside of the screw portion with the outside of the screw portion. When the fuel outlet port 70*b* is constructed of a pipe member, a bulge portion 702 may be provided around the fuel outlet port 70*b* so as to restrict detachment of a tube, which is to be connected with the fuel outlet port 70*b*. Further, the rear cover 70 has a discharge port 70*c* of the feed pump portion 5, a discharge passage 70*d*, a communication passage 70*e*, and the return passage 14. The discharge passage 70*d* communicates the discharge port 70*c* with the fuel outlet port 70*b*. The communication passage 70*e* communicates the discharge passage 70*d* with a pressure-receiving side of the valve element portion 15*b* of the return valve 15. The return passage 14 returns fuel from the return valve 15 to an intake port 70*f* of the feed pump portion 5.

Next, an operation of the fuel feed apparatus is described. First, the camshaft 61 of the high-pressure pump portion 6 rotates in conjunction with the operation of the diesel engine in the vehicle. The camshaft 61 is connected with the feed pump portion 5, so that the camshaft 61 transmits driving force to the feed pump portion 5. The feed pump portion 5 is transmitted with the driving force, thereby pumping fuel from the fuel tank 4 through the inlet pipe 4*a*. In the present operation, fuel passes through the pre-filter 8 and the gauze filter 10 in this order, thereby being filtered. The fuel press-fed from the feed pump portion 5 is further filtered through the fuel filter 12, and the fuel flows into the inlet control valve 7 after passing through the fuel passage 12*a*. The ECU controls the opening of the inlet control valve 7 by transmitting the control signal, so that fuel flows into the high-pressure pump portion 6 through the fuel passage 7*a* by an amount sufficient for the operation of the diesel engine of the vehicle.

The cam 63 rotates together with the camshaft 61, thereby axially actuating the plunger 62 in the high-pressure pump portion 6. The plunger 62 moves toward the camshaft 61 in the cylinder 3*b* by being axially actuated, so that the high-pressure pump chamber 65 increases in volume and decreases in pressure. In the present operation, the inlet valve 66 opens to draw fuel from the downstream of the inlet control valve 7 into the high-pressure pump chamber 65 after passing through the fuel passage 7*a* and the inlet passage 65*a* in order. Alternatively, the plunger 62 moves away from the camshaft 61 in the cylinder 3*b*, so that the high-pressure pump chamber 65 decreases in volume, thereby compressing fuel drawn into the high-pressure pump chamber 65. When pressure of the compressed fuel becomes greater than the predetermined pressure, the outlet valve 67 opens, so that fuel is press-fed from the high-pressure pump chamber 65 into the common rail 1 after passing through the outlet passage 65*b* and the fuel passage 1*c* in order. Thus, the common rail 1 accumulates high-pressure fuel. The high-pressure fuel accumulated in the common rail 1 is injected into the combustion chamber of the diesel engine through the injector 2, which is manipulated in accordance with the control signal transmitted from the ECU.

As follows, an operation effect of the fuel feed apparatus will be described. According to the fuel injection pump 3 in the present embodiment, the mounting hole 70*a*, to which the return valve 15 is attached, is formed in the rear cover 70. The rear cover 70 is a separate component from both the pump housing 3*a* and the feed pump cover 53. The definition of the separate may include individual and distinct. That is, the rear cover 70 (valve cover) is a separate component from the pump housing 3*a* and the feed pump cover 53 (low-pressure pump cover), regardless of being combined or not.

Therefore, interference with the multiple fuel passages and the like provided in the pump housing 3*e* and deformation of the interior of the feed pump cover 53 need not be considered when the mounting hole 70*a* is manufactured. Consequently, manufacturing of the mounting hole 70*a* of the return valve 15 can be sufficiently facilitated. In addition, the fuel outlet port 70*b*, from which the feed pump portion 5 press-feeds fuel, and the communication passage 70*e*, which communicates the fuel outlet port 70*b* with the pressure receiving side of the valve element portion 15*b* of the return valve 15, are formed in the rear cover 70. Therefore, an additional pipe for communicating the fuel outlet port 70*b* of the feed pump cover 53 with the pressure receiving side of the valve element portion 15*b* need not be provided. Thus, the fuel injection pump can be avoided from increasing in size. Further, the longitudinal direction of the return valve 15 is substantially at a 90 degree angle with respect to the axial direction of the camshaft 61. In the present structure, the longitudinal direction of the return valve 15 is substantially in parallel with the wall surface of the pump housing 3*a*, to which the feed pump portion 5 is fixed. Therefore, the fuel injection pump can be restricted from being enlarged because of mounting of the return valve 15 to the rear cover 70. Further, both the rear cover 70 and the feed pump cover 53 are fixed to the pump housing 3*a* by using the bolts 80. Therefore, the rear cover 70 and the feed pump cover 53 can be easily fixed. Furthermore, the rear cover 70 and the feed pump cover 53 are configured as separate components. Therefore, the hardness of the material of the rear cover 70 may be lower than the hardness of the material of the feed pump cover 53. In short, the rear cover 70 may be formed from a material, which is excellent in workability, compared with the feed pump cover 53. In the present structure, workability of the mounting hole 70*a* can be further enhanced.

Second Embodiment

In the first embodiment, the axial direction (longitudinal direction) of the mounting hole 70*a* of the return valve 15 is at an angle with respect to the axial direction of the camshaft 61 in the rear cover 70. By contrast, in the present second embodiment, as shown in FIG. 7, the axial direction of the mounting hole 70*a* is substantially in parallel with the axial direction of the camshaft 61 in the rear cover 70.

Figure 7A:
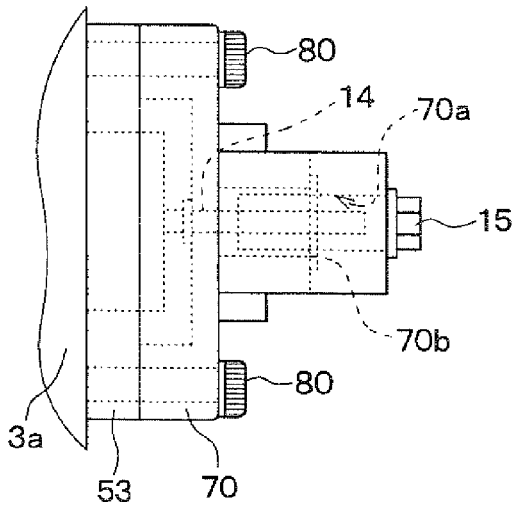
FIG. 7A is an enlarged view showing a feed pump according to a second embodiment.
Figure 7B:
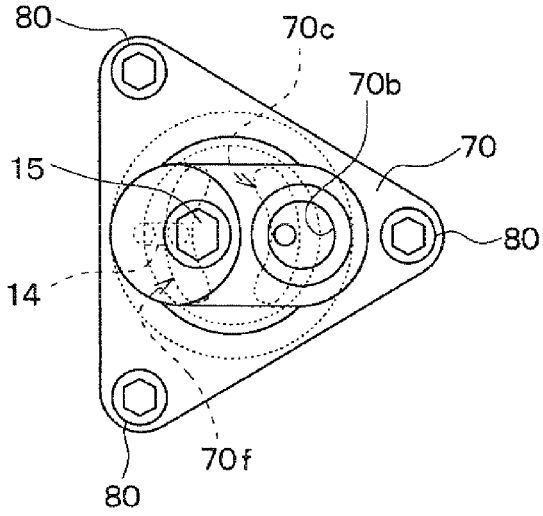
FIG. 7B is a top view when being viewed from an axial direction.
Figure 7C:
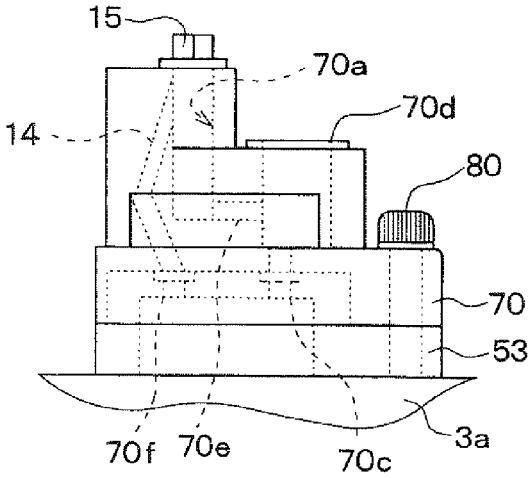
FIG. 7C is a lateral view showing the feed pump.

Each of FIGS. 7A to 7C is an enlarged view showing the feed pump portion 5 according to the present second embodiment, and corresponds to each of FIGS. 5A to 5C. According to the fuel injection pump 3 in the present second embodiment, workability of the mounting hole 70*a* of the return valve 15 can be sufficiently enhanced, similarly to the first embodiment. Thus, the fuel injection pump can be restricted from being enlarged.

Third Embodiment

Figure 8:
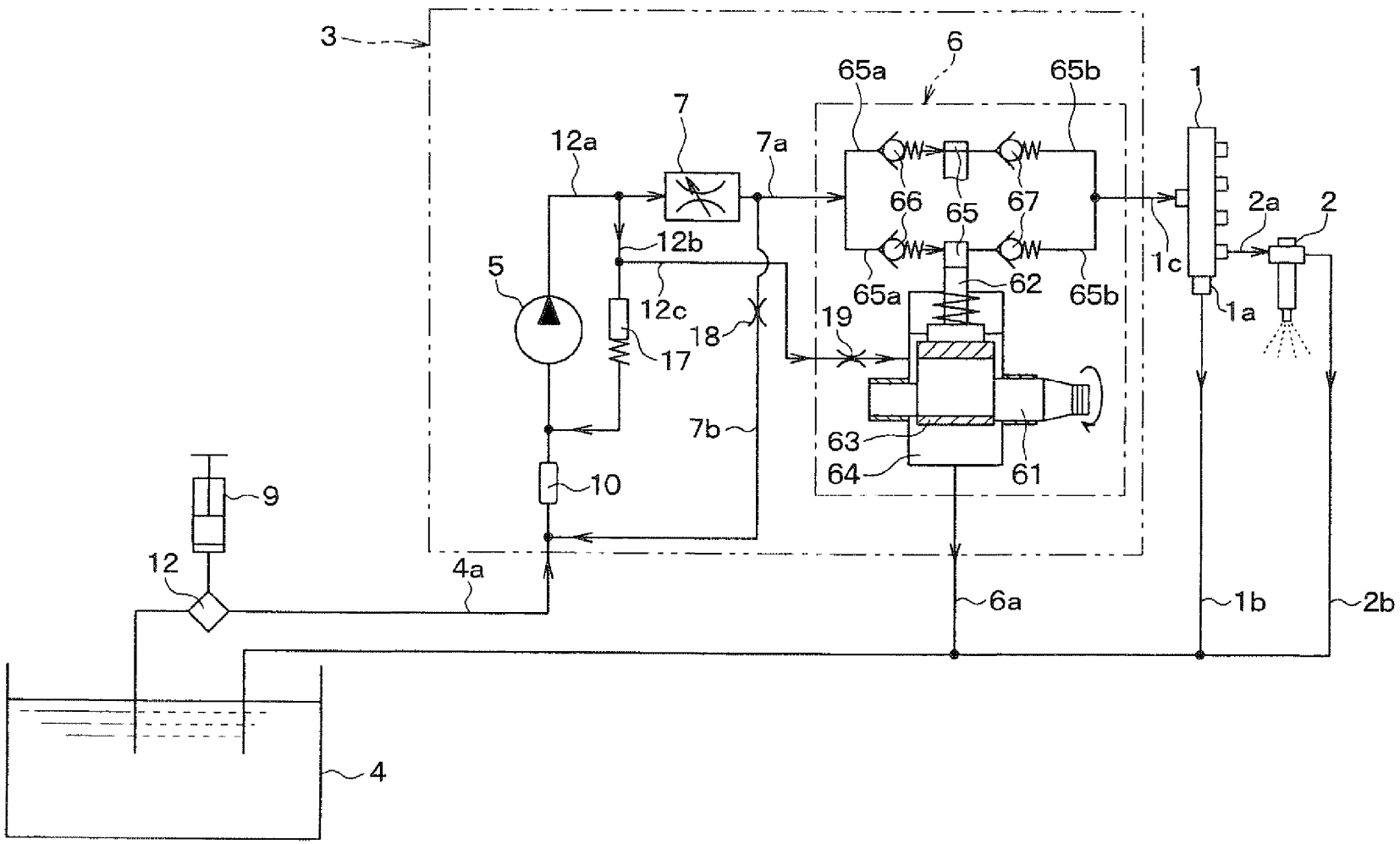
FIG. 8 is a schematic diagram showing an accumulator fuel injection system according to a third embodiment.

As described above, according to the first embodiment, the fuel injection pump 3 is applied to the accumulator fuel injection system, which includes the fuel filter 12 at the downstream of the feed pump portion 5. On the other hand, in the present third embodiment as shown in the FIG. 8, the fuel fitter 12 is located at the upstream of the feed pump portion 5 in the accumulator fuel injection system. According to the present embodiment, in response to modification of the location of the fuel filter 12, the bypass passage 4*b*, the check valve 11, the relief valve 13, the fuel pipe 13*a*, the return passage 14, the orifice 16, and the return valve 15 are omitted.

In the present structure, fuel discharged from the feed pump portion 5 directly flows into the fuel passage 12*a* without flowing out of the fuel injection pump 3. Furthermore, the return valve 15 is also omitted, and therefore the regulator valve 17 is attached to the mounting hole 70*a* of the rear cover 70. The fuel passage inside the rear cover 70 is also modified in response to the above modification. The structure of the fuel injection pump other than the feature of the present embodiment is substantially equivalent to that of the first embodiment. Even in the present third embodiment, in which the regulator valve 17 is provided to the mounting hole 70*a* of the rear cover 70, workability of the mounting hole 70*a* can be sufficiently enhanced similarly to the first embodiment. In addition, the fuel injection pump can be restricted from being enlarged.

Other Embodiment

The structure of the fuel injection pump according to the first to third embodiments may be arbitrary modified. For example, the fuel injection pump may be variously modified, as follows.

Figure 9A:
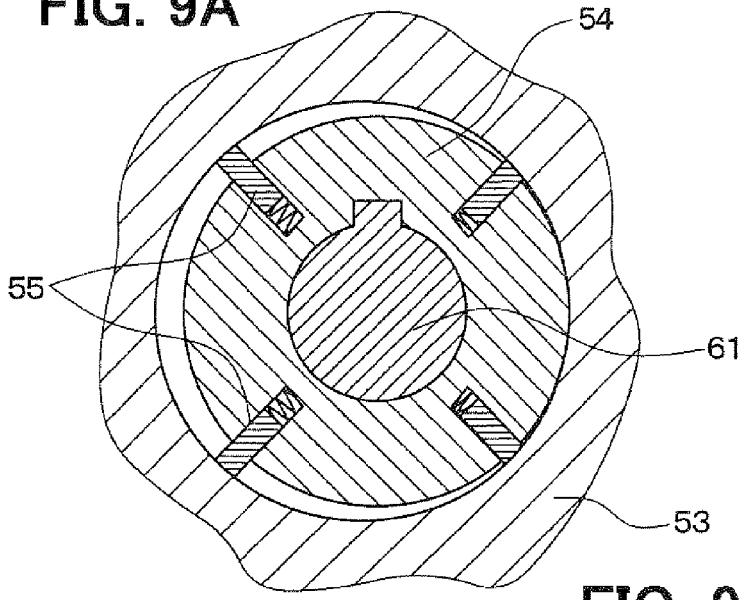
FIG. 9A is a sectional view showing a vane pump.
Figure 9B:
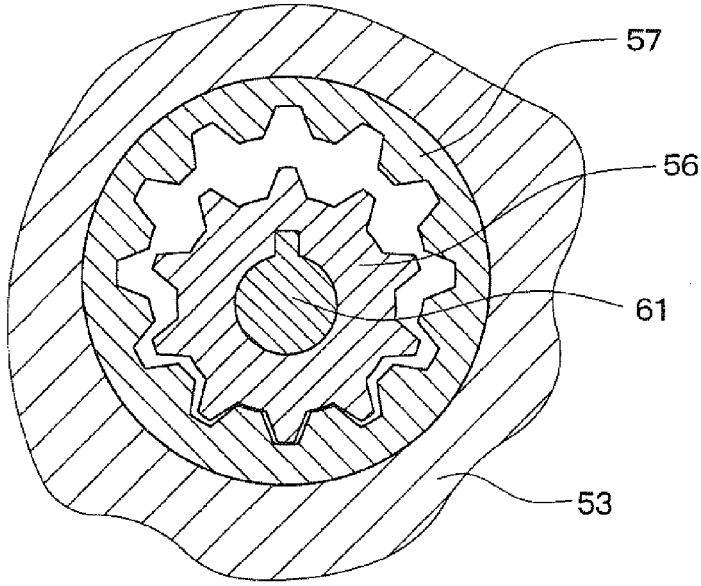
FIG. 9B is a sectional view showing a gear pump, according to another embodiment.

(1) In the above embodiments, a trochoid pump is employed as the feed pump portion 5. However, the feed pump portion is not limited to a trochoid pump. For example, as shown in FIG. 9A, a vane pump, which includes a rotor 54 and a rotatable member having multiple vanes 55, may be employed as the feed pump portion 5. Alternatively, as shown in FIG. 9B, a gear pump, which includes a rotatable member having an inner gear 56 and an outer gear 57, may be employed as the feed pump portion 5. Alternatively, various pumps such as a positive-displacement pump, a rolling piston pump, and a vane pump may be employed as the feed pump portion 5.

(2) In the above embodiments, the high-pressure pump portion 6 is a single-type high-pressure pump having the two plungers 62 opposed to each other radially via the camshaft 61. Alternatively, the high-pressure pump portion 6 may be a tandem-type high-pressure pump having four plungers 62 arranged around the camshaft 61 with respect to the rotative direction thereof.

(3) In the above embodiments, either the return valve 15 or the regulator valve 17 is inserted and mounted to the rear cover 70. Alternatively, both the return valve 15 and the regulator valve 17 may be mounted to the rear cover 70.

(4) In the first embodiment, the return passage 14 is directly connected with the passage between the downstream (outlet) of the feed pump portion 5 and the upstream (inlet) of the feed pump portion 5. However, the physical relationship among the feed pump portion 5 and other components is not limited to the above example. Fuel may be returned from the downstream of the fuel filter 12 to the upstream of the feed pump portion 5, for example.

(5) In each of the above embodiments, the fuel injection pump is applied to the accumulator fuel injection system, i.e., an inlet control accumulator fuel injection system including the inlet control valve 7 for controlling flow of fuel to be compressed using the high-pressure pump portion 6. Alternatively, the fuel injection pump may be applied to an accumulator fuel injection system capable of controlling flow of press-fed fuel to the common rail by controlling valve-close timing of an outlet valve of a variable flow high-pressure pump, i.e., a pre-stroke control accumulator fuel injection system.

Figure 10:
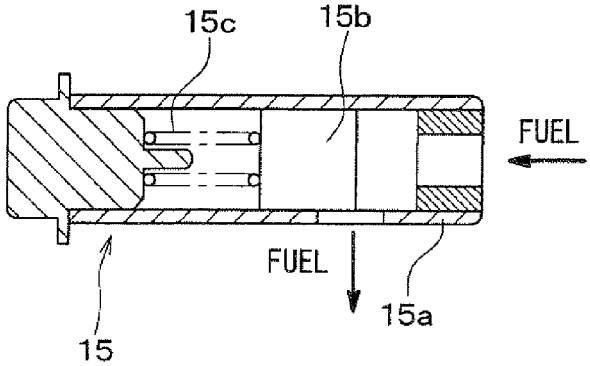
FIG. 10 is a schematic sectional view showing a return valve according to another embodiment.

(6) In the above embodiments, as shown in FIG. 4, the return valve 15 having the ball valve is employed as the valve element. Alternatively, as shown in FIG. 10, a return valve 15 having a piston valve may be employed as the valve element.

In the above embodiments the longitudinal direction of the fuel pressure regulating valve is at an angle with respect to the axial direction of the camshaft. The present definition is not limited to the structure in which the longitudinal direction of the fuel pressure regulating valve is at the 90 degree angle with respect to the axial direction of the camshaft. The present definition includes a structure in which the longitudinal direction of the fuel pressure regulating valve is inclined with respect to the axial direction of the camshaft. That is, the inclination angle between the longitudinal direction of the fuel pressure regulating valve and the axial direction of the camshaft may be arbitrary determined.

The above structures of the embodiments can be combined as appropriate. Various modifications and alternations may be diversely made to the above embodiments without departing from the spirit of the present invention.

What is claimed is:

1. A fuel injection pump comprising:

a low-pressure pump portion configured to pump fuel from a fuel tank;

a pressure regulating valve configured to control pressure of fuel discharged from the low-pressure pump portion;

a high-pressure pump portion configured to pressurize fuel discharged from the low-pressure pump portion to press-feed the fuel;

a valve cover having a mounting portion, which is configured to be mounted with the pressure regulating valve; and a fuel filter through which the high-pressure pump portion is configured to draw fuel discharged from the low-pressure pump portion, wherein the pressure regulating valve is configured to release fuel pressure applied to the fuel filter such that the fuel pressure applied to the fuel filter becomes less than predetermined pressure, wherein the high-pressure pump portion includes a cylinder, a movable member, and a camshaft, the cylinder defines a high-pressure pump chamber for compressing fuel, the movable member is configured to move to pressurize fuel in the high-pressure pump chamber to press-feed the fuel, the camshaft is configured to move the movable member, the low-pressure pump portion includes a rotatable member and a pump cover, the rotatable member is rotatable integrally with the camshaft, the pump cover accommodates the rotatable member, the pump cover is fixed to the pump housing, the valve cover is a separate component from the pump housing and the pump cover, the pressure regulating valve includes a valve element configured to open the pressure regulating valve in response to pressure of fuel, the valve cover has an outlet port and a communication passage, the outlet port is configured to discharge fuel, which is pressurized in the low-pressure pump portion, the communication passage is configured to communicate a pressure receiving side of the valve element with the outlet port, a longitudinal direction of the pressure regulating valve is at an angle with respect to an axial direction of the camshaft, the valve cover and the pump cover are fixed to the pump housing via a common fixing member, the valve cover is formed from a first material, the pump cover is formed from a second material, the first material is lower than the second material in hardness, the valve cover has a triangular shape when viewed in the axial direction of the camshaft, and the valve cover has a fuel outlet port located nearer to one of three corners of the triangular shape thereof than to the other two of those three corners.

2. The fuel injection pump according to claim 1, wherein the valve cover has a return passage, which is configured to return fuel from the pressure regulating valve to an upstream of the low-pressure pump portion.

3. The fuel injection pump according to claim 1, wherein the valve cover has a return passage, which is configured to introduce fuel in a passage, which is located at a downstream of the low-pressure pump portion and located at an upstream of the fuel filter, to return the fuel from the pressure regulating valve to an upstream of the low-pressure pump portion.

4. The fuel injection pump according to claim 1, wherein the valve cover is screwed to the pump housing via the pump cover.

5. The fuel injection pump according to claim 1, wherein the longitudinal direction of the pressure regulating valve is substantially at a 90 degree angle with respect to the axial direction of the camshaft.

6. The fuel injection pump according to claim 1, wherein the rotatable member and the pump cover define a plurality of cavity portions in the low-pressure pump portion to pump fuel in response to change in volume of the plurality of cavity portions.

7. The fuel injection pump according to claim 1, wherein the common fixing member includes three bolts, and the three bolts are screwed and fixed to the pump housing so as to pass through through-holes formed near the three corners of the triangular valve cover.

8. The fuel injection pump according to claim 1, wherein the pressure regulating valve is screwed to a mounting hole that is provided in the valve cover as the mounting portion, and attached to the valve cover.

* * * * *